US005555871A

United States Patent [19]

Gopp et al.

[11] Patent Number: 5,555,871

[45] Date of Patent: Sep. 17, 1996

[54] METHOD AND APPARATUS FOR PROTECTING AN ENGINE FROM OVERHEATING

[75] Inventors: Alexander Y. Gopp, Ann Arbor; Richard W. Sbaschnig, Dearborn; Richard L. Buonocore, Sterling Heights, all of Mich.

[73] Assignee: Ford Motor Company, Dearborn, Mich.

[21] Appl. No.: 436,896

[22] Filed: May 8, 1995

[51] Int. Cl.[6] ..... F02D 41/22; F02D 41/04; F02D 17/02

[52] U.S. Cl. ..... 123/481; 123/198 D

[58] Field of Search ..... 123/41.15, 198 D, 123/198 DB, 198 F, 481

[56] References Cited

U.S. PATENT DOCUMENTS

| | | | |
|---|---|---|---|
| 3,158,143 | 11/1964 | Heidner | 123/198 DC |
| 3,301,245 | 1/1967 | Woodburn | 123/198 DB |
| 3,738,346 | 6/1973 | Goodman | 123/198 DB |
| 3,760,781 | 9/1973 | Boldt | 123/198 DC |
| 3,820,326 | 6/1974 | Inoue et al. | 60/277 |
| 4,015,428 | 4/1977 | Kawai | 60/277 |
| 4,024,850 | 5/1977 | Peter et al. | 123/198 F |
| 4,080,947 | 3/1978 | Iizuka | 123/198 F |
| 4,117,822 | 10/1978 | Mills | 123/198 DB |
| 4,129,109 | 12/1978 | Matsumoto | 123/198 F |
| 4,134,261 | 1/1979 | Iizuka et al. | 60/276 |
| 4,146,006 | 3/1979 | Garabedian | 123/198 F |
| 4,227,505 | 10/1980 | Larson et al. | 123/198 F |
| 4,276,863 | 7/1981 | Sugasawa et al. | 123/481 |
| 4,292,938 | 10/1981 | Tanaka et al. | 123/198 F |
| 4,473,045 | 9/1984 | Bolander et al. | 123/198 F |
| 4,550,704 | 11/1985 | Barho et al. | 123/481 |
| 4,629,471 | 12/1986 | Kurihara et al. | 123/198 DB |
| 4,695,822 | 9/1987 | Furukawa | 123/41.15 |
| 4,945,878 | 8/1990 | Daly et al. | 123/41.15 |
| 5,094,192 | 3/1992 | Seiffert et al. | 123/41.15 |
| 5,133,303 | 7/1992 | Umehara | 123/41.15 |
| 5,408,974 | 4/1995 | Lipinski et al. | 123/481 |
| 5,425,335 | 6/1995 | Miyamoto et al. | 123/198 F |

FOREIGN PATENT DOCUMENTS

| | | | |
|---|---|---|---|
| 2296764 | 7/1976 | France . | |
| 2312651 | 12/1976 | France . | |
| 2419399 | 10/1979 | France . | |
| 1245210 | 7/1967 | Germany . | |
| 2319576 | 11/1974 | Germany . | |
| 2336522 | 2/1975 | Germany . | |
| 2340541 | 2/1975 | Germany . | |
| 3135634 | 3/1983 | Germany . | |
| 3301318 | 8/1983 | Germany | 123/198 D |
| 52-50493 | 4/1977 | Japan . | |
| 57-193716 | 11/1982 | Japan . | |
| 57-193737 | 11/1982 | Japan . | |
| 58-57042 | 4/1983 | Japan . | |
| 58-150053 | 9/1983 | Japan . | |
| 0767381 | 9/1980 | U.S.S.R. . | |
| 0979676 | 12/1982 | U.S.S.R. . | |
| 2067663 | 7/1981 | United Kingdom . | |

*Primary Examiner*—Willis R. Wolfe
*Attorney, Agent, or Firm*—Allan J. Lippa; Roger L. May

[57] ABSTRACT

A method and apparatus for protecting an engine from overheating. The apparatus comprises a cylinder head temperature sensor operably coupled to sense the temperature of the cylinder head and a control system operably coupled to the cylinders and the cylinder head temperature sensor such that when the temperature of the cylinder head exceeds a maximum level the control system deactivates one or more of the cylinders and rotates the deactivation of one or more engine cylinders such that no one cylinder is constantly fired thus providing engine cooling by drawing fresh air through the deactivated one or more cylinders.

23 Claims, 9 Drawing Sheets

| Cylinder Number | 2 | 4 | 3 | 1 | | |
|---|---|---|---|---|---|---|
| Event Number | 4 | 3 | 2 | 1 | Cyl off | Cal Code |
| Cal Value | 8 | 4 | 2 | 1 | | |
| | 0 | 0 | 0 | 0 | 0 | 0 |
| | 0 | 0 | 0 | 1 | 1 | 1 |
| | 0 | 1 | 0 | 1 | 2 | 5 |
| | 0 | 1 | 1 | 1 | 3 | 7 |
| | 1 | 1 | 1 | 1 | 4 | 15 |

Event Number - Combustion Event Counter;
Bit = 1 - represents cylinder turned off

Fig. 6

| Engine Cycle Period | Cylinder Number 1 | 2 | 3 | 4 |
|---|---|---|---|---|
| 1 | 1 | 0 | 0 | 1 |
| 2 | 0 | 1 | 1 | 0 |
| 3 | 1 | 0 | 0 | 1 |
| 4 | 0 | 1 | 1 | 0 |

Fig. 7

| Cylinder Rotation | Cylinder Number 1 | 2 | 3 | 4 | 5 | 6 | 7 | 8 |
|---|---|---|---|---|---|---|---|---|
| 1 | 1 | 0 | 0 | 0 | 0 | 1 | 0 | 0 |
| 2 | 0 | 0 | 1 | 0 | 1 | 0 | 0 | 0 |
| 3 | 0 | 0 | 0 | 1 | 0 | 0 | 1 | 0 |
| 4 | 0 | 1 | 0 | 0 | 0 | 0 | 0 | 1 |
| 5 | 1 | 0 | 0 | 0 | 0 | 1 | 0 | 0 |

Fig. 8

| Cylinder Rotation | Cylinder Number 1 | 2 | 3 | 4 | 5 | 6 | 7 | 8 |
|---|---|---|---|---|---|---|---|---|
| 1 | 0 | 1 | 1 | 0 | 1 | 0 | 0 | 1 |
| 2 | 1 | 0 | 0 | 1 | 0 | 1 | 1 | 0 |
| 3 | 0 | 1 | 1 | 0 | 1 | 0 | 0 | 1 |

Fig. 9

METHOD AND APPARATUS FOR PROTECTING AN ENGINE FROM OVERHEATING

TECHNICAL FIELD

This invention relates to a method and apparatus for protecting an engine from overheating.

BACKGROUND ART

It is generally well known that malfunctions of an engine cooling system will result in damage to the engine due to excessive engine overheating. Malfunction of an engine cooling system may result when there is a loss of coolant from the cooling system. Such a loss may occur when there is a leak in the cooling system or through a more gradual loss of coolant which may occur when operating under adverse conditions, such as driving uphill with a full load on a hot day. Alternatively, a malfunction of the cooling system may occur even without a loss of coolant. For example, if the coolant circulation system malfunctions, such as if the water pump is not working properly, the engine may overheat.

The deactivation of engine cylinders in response to engine overheating is known in the art. For example, U.S. Pat. No. 4,158,143 issued on Nov. 24, 1964 to Heidner for a "Ignition System Including Thermostatically Controlled Means For Reducing Power Output." The system disclosed in the Heidner patent includes an ignition system incorporating a thermostatic means to monitor the engine temperature. When overheating of the engine is detected, as the result of a cooling system failure for example, the thermostatic means provides a warning signal to the ignition system to interrupt the firing of at least one of the spark plugs while permitting continued sparking of at least another one of the spark plugs. Accordingly, the engine will still continue to operate, but at a reduced power level. As a result, a lesser amount of heat will be generated and the operating temperature of the engine may be reduced, thereby allowing continued operation of the engine at that reduced power level.

Regarding an electronic fuel injected engine having a pair of cylinders groups, it is also known in the art that alternately deactivating the fuel supply to those two cylinders groups will result in a cooling effect. For example, U.S. Pat. No. 4,129,109 issued on Dec. 12, 1978 to Matsumoto. In the Matsumoto patent, it is noted that the deactivation of engine cylinders can be effected by electrically cutting off the supply of injection pulses to one of the groups of engine cylinders. The resultant cooling effect is noted as follows: "Therefore, air flow is sucked into the deactivated cylinders in each cylinder cycle as well as into the activated cylinders so that the deactivated cylinder is severely cooled as compared to the activated cylinders." Matsumoto patent, column 1, lines 30–33.

As suggested by the Heidner and Matsumoto patents, the technologies disclosed in the Heidner and Matsumoto patents were combined in U.S. Pat. No. 4,473,045 issued on Sep. 25, 1984 to Bolander et al. for a "Method And Apparatus For Controlling Fuel To An Engine During Coolant Failure." The Bolander patent discloses a fuel injected engine having two groups of electromagnetic fuel injectors for first and second predetermined groups of cylinders. Fuel injection pulses are supplied to each of the fuel injector groups via one of two driver circuits. The cooling system is monitored via a conventional liquid sensing element in the coolant system and a conventional temperature sensing element mounted in the engine block. In the event the monitors detect a cooling system failure, an engine control module, described as a digital computer, deactivates the fuel injection pulses to one of the driver circuits, thereby deactivating the first of two groups of cylinders which will then be cooled by the induction of air only. After a predetermined time period substantially greater than the period of the engine cycle, the engine control module will then alternate and inhibit the supply of fuel to the second of the two groups of cylinders while allowing fuel to be supplied to the first group of cylinders.

The apparatuses and methods disclosed in these prior art patents leave a number of problems unsolved. First, deactivation of cylinders based upon coolant level or engine block temperature may not be sufficient to prevent damage. In the event of a circulation malfunction within the cooling system, a liquid sensor may not detect any problem at all and an engine block temperature sensor may not detect a problem until damage occurs to the cylinder head.

Second, instead of relying on the deactivation of a set predetermined group of cylinders, it may be desirable to deactivate a variable number of cylinders depending on the load conditions. In other words, it may be desirable to deactivate one or more of the cylinders, up to one less the total number of cylinders. For example, under low load conditions, it may not be necessary to deactivate more than one or a small number of cylinders. Likewise, under heavy load conditions, it may be desirable to deactivate a larger number of cylinders, up to one less than the total number of cylinders.

SUMMARY OF INVENTION

An object of this invention is to provide a new and improved method and apparatus for protecting an engine from overheating.

In accordance with the teaching of this invention, the overheat protection system comprises a cylinder head temperature sensor operably coupled to sense the temperature of the cylinder head of an engine. A control system is operably coupled to the cylinders of the engine and the cylinder head temperature sensor such that when the temperature of the cylinder head exceeds a maximum level, the control system will deactivate one or more of the cylinders and rotate the deactivation of one or more engine cylinders such that no one cylinder is constantly fired thus providing engine cooling by drawing fresh air through the deactivated one or more cylinders.

The method for protecting an internal combustion engine from overheating in accordance with the teaching of this invention comprises sensing the temperature of the cylinder head of an engine, deactivating one or more engine cylinders when the temperature of the cylinder head exceeds a maximum level, and rotating the deactivation of one or more engine cylinders such that no one cylinder is constantly fired thus providing engine cooling by drawing fresh air through the deactivated one or more cylinders.

The method and apparatus disclosed and claimed provides several advantages.

One advantage is that the cooling system or method is not activated by the engine coolant level or temperature, or by the engine block temperature, but by the temperature of the cylinder head. Accordingly, overheating may be detected and corrected before damage occurs to the cylinder head.

Another advantage to this system and method is that one or more of the cylinders, up to one less the total number of cylinders, may be deactivated only as necessary to effect the desired cooling.

These advantages, and other objects, features, and advantages of the present invention, will be readily appreciated by one of ordinary skill in the art from the following detailed description of the best mode for carrying out the invention when taken in conjunction with the accompanying drawings.

BRIEF DESCRIPTION OF DRAWINGS

While the details and advantages of the present invention may be understood by reference to the drawings, the appended claims are intended to cover other embodiments, including all modifications and equivalents that follow from the true spirit and scope of this invention.

FIG. 6 is a matrix showing the bit pattern and calibration for a 4-cylinder engine in accordance with an embodiment of this invention;

FIG. 7 is a matrix showing the cylinder firing for a 4-cylinder engine when two cylinders are deactivated;

FIG. 8 is a matrix showing the cylinder firing for an 8-cylinder engine when two cylinders are deactivated;

FIG. 9 is a matrix showing the cylinder firing for an 8-cylinder engine when four cylinders are deactivated.

BEST MODE FOR CARRYING OUT THE INVENTION

Figure 1:
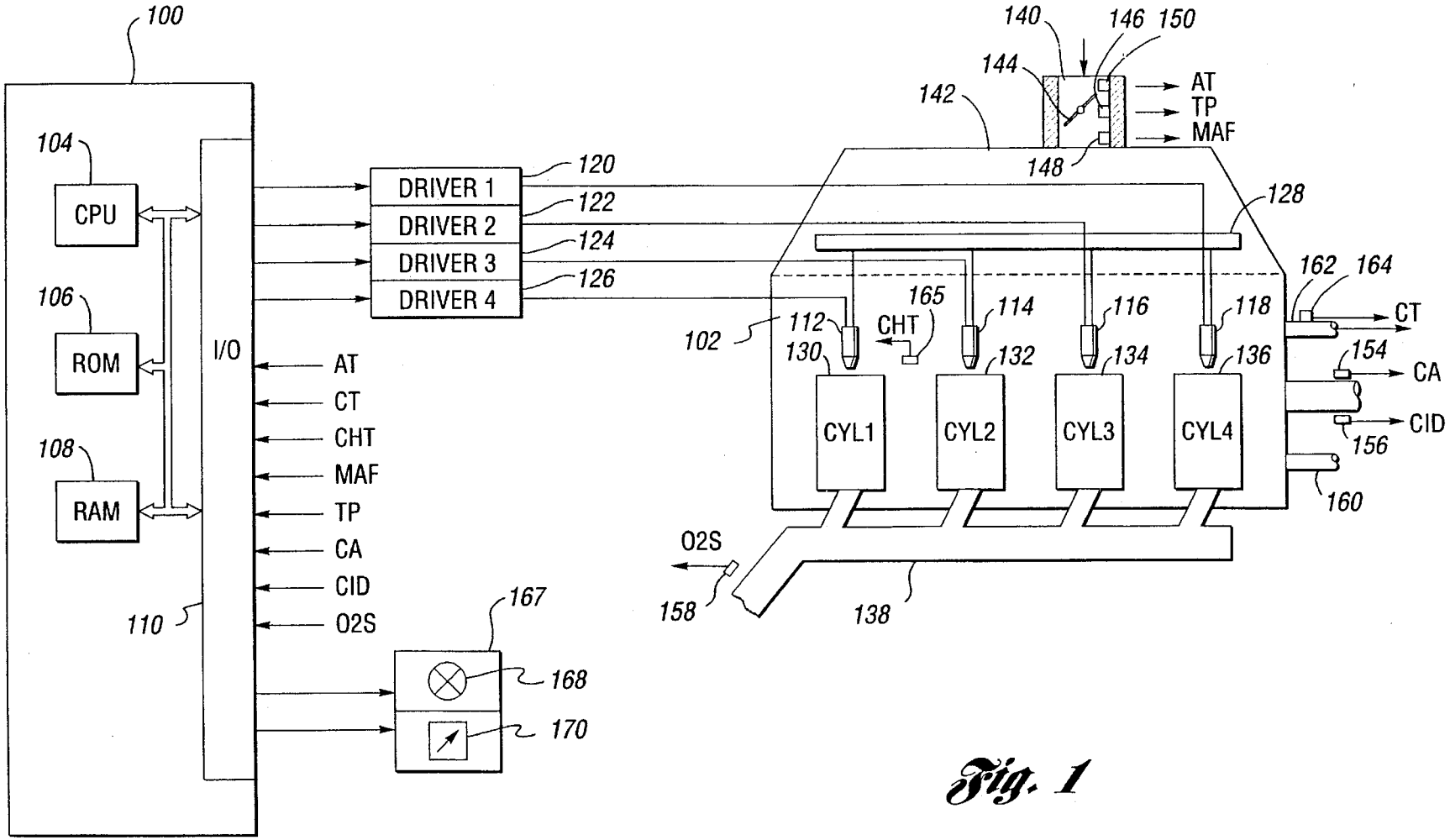
FIG. 1 is a schematic view of an internal combustion engine incorporating an embodiment of this invention.

FIG. 1 is a schematic view of an internal combustion engine 102 incorporating an embodiment of the invention. A control system, which in the embodiment shown comprises a microcomputer 100, is shown for controlling the air/fuel ratio supplied to the internal combustion engine 102. The microcomputer 100 comprises a central processing unit (CPU) 104, a read-only memory (ROM) 106 for storing main routines and other routines such as a fuel flow routine and calibration constants, tables, etc., a random access memory (RAM) 108, and a conventional input/output (I/O) interface 110. The interface 110 includes analog to digital (A/D) converters for converting various analog input signals to digital inputs, and digital to analog (D/A) converters for converting various digital outputs to analog output signals.

The microcomputer 100 also includes conventional elements such as a clock generator and means for generating various clock signals, counters, drivers and the like (not shown). The microcomputer 100 controls the air/fuel ratio by controlling the fuel flow through electronically energized fuel injectors 112, 114, 116 and 118. Those injectors are energized by injector drivers 120, 122, 124 and 126, respectively, which in turn are controlled by the microcomputer 100 in response to various operating parameters of the engine 102.

The engine 102 shown in FIG. 1 is a four-cylinder engine. Each fuel injector 112, 114, 116 and 118 is coupled to a fuel rail 128. Each of the fuel injectors 112, 114, 116, and 118 is also operably coupled in a conventional manner to respective combustion cylinders 130, 132, 134 and 136 which are all located in a cylinder head. Exhaust gases from each of the combustion cylinders 130, 132, 134 and 136 are routed to an exhaust manifold 138 and discharged. An air intake 140 is shown coupled to an intake manifold 142 for inducting air past a throttle plate 144 into the combustion cylinders 130, 132, 134, and 136. Because such couplings are well-known in the art, they will not be discussed further here.

The engine 102 is also equipped with a number of different sensors coupled to the microcomputer 102 for providing engine operating parameters required for calculating control actions. A throttle position sensor 146 is shown coupled to the throttle plate 144 for providing a throttle position signal TP. A mass air flow sensor 148 is coupled to the microcomputer 102 for providing a mass air flow signal MAF relating to the mass air flow induced into the engine 102. An air temperature sensor 150 is also coupled to the microcomputer 102 for providing a signal AT indicative of the temperature of induced air.

A crank angle position sensor 154 and cylinder identification sensor 156 are operably coupled to a crankshaft of the engine 102 for providing a crank angle position signal CA indicative of the crank position and a cylinder identification signal CID which allows identification of the cylinder number in relationship to the crank position.

An exhaust gas oxygen sensor 158 is operably coupled to the exhaust manifold 138 for providing an oxygen concentration signal indicative of the exhaust gas oxygen.

During normal operating conditions, the engine 102 is cooled by coolant flowing through a cylinder block. The coolant enters the engine 102 through an inlet hose 160 and discharges through an outlet hose 162. A coolant temperature sensor 164 is located in the outlet hose 162 for providing a coolant temperature signal CT. While the coolant temperature sensor 164 will generally provide a fairly accurate temperature measurement, if the coolant flow to the outlet hose 162 is restricted or interrupted, the signal CT from the coolant temperature sensor 164 may not represent an accurate reflection of the engine temperature.

Figure 2:
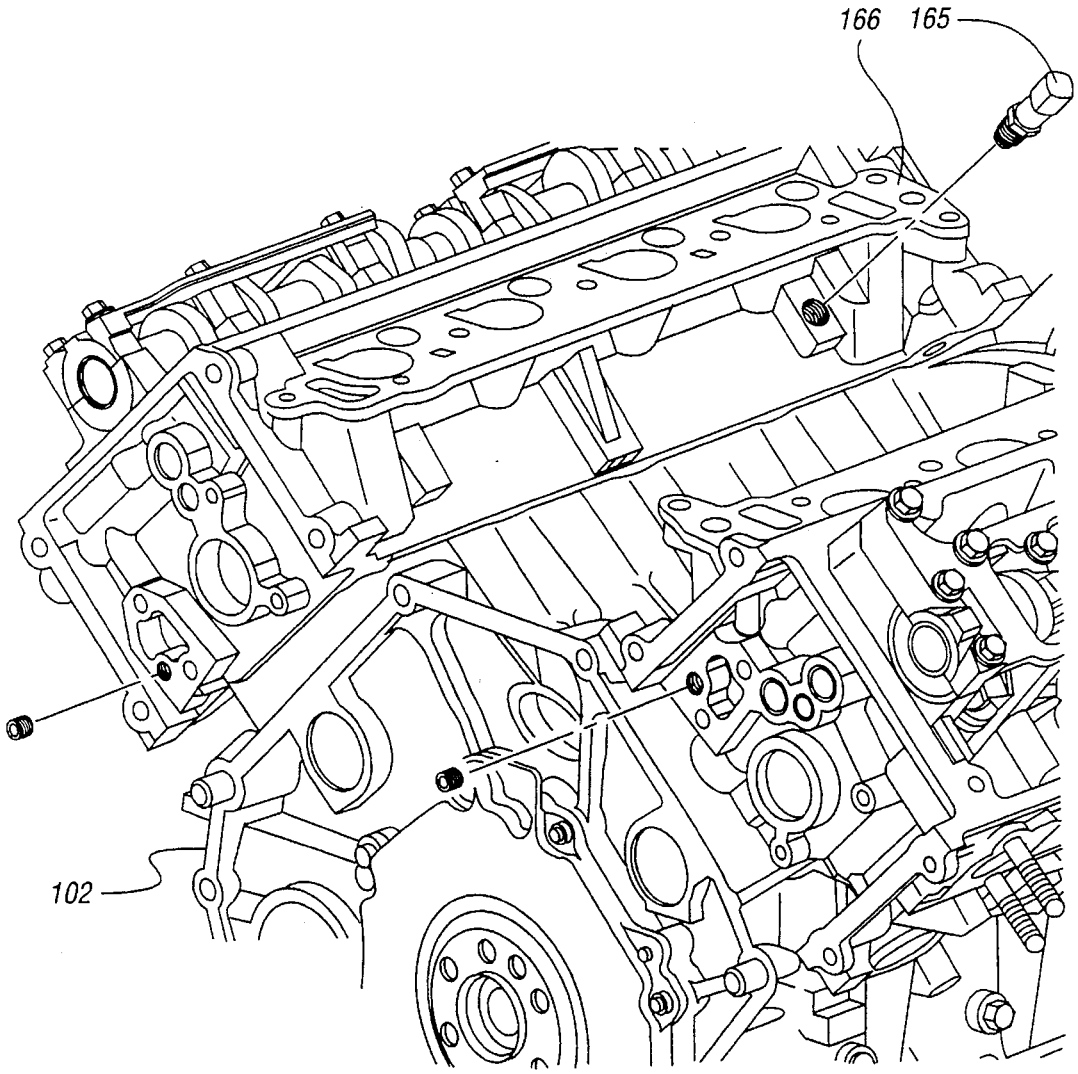
FIG. 2 is a perspective view of an internal combustion engine illustrating placement of the cylinder head temperature sensor in the cylinder head.

As shown in FIG. 1, and in greater detail in FIG. 2, a cylinder head temperature sensor 165 such as a thermistor assembly is mounted within the cylinder head 166 of the engine 102 for providing a cylinder head temperature signal (CHT) related to the temperature condition of the cylinder head. Because such thermistor assemblies, comprising a connector housing, a thermistor, and a bulb, are well known in the art, they will not be discussed in further detail. However, the preferred durability is such that the resistance change after 1,000 hours at 200° C. will be less than 2.5% as measured at a nominal temperature (25° C.). It is also preferred that the insulation tubing on the leads be able to withstand a 200 VDC high-potential test and that the maximum leakage current not exceed 5 microamperes. The preferred thermal time constant is 20 seconds maximum as measured by the self-heating method from 70° C. to 30° C. in still air. Regarding accuracy of the thermistor assembly, it has been found preferred to stay within the parameters set forth on the following resistance chart. The resistance is preferably checked in a circulating oil bath with the temperature held within ±0.03° C. Bath error should not be included in making the resistance determination.

| TEMP | NO LOAD RESISTANCE-OHMS | | |
|---|---|---|---|
| °C. | NOM | MIN | MAX |
| −40 | 965530 | 771126 | 1159933 |
| −20 | 283651 | 235083 | 332218 |
| −10 | 162585 | 137003 | 188166 |
| 0 | 96248 | 82373 | 110123 |
| 20 | 37387 | 32650 | 42124 |
| 25 | 30000 | 26316 | 33684 |
| 40 | 16043 | 14245 | 17041 |
| 60 | 7487 | 6745 | 8230 |
| 100 | 2038 | 1876 | 2200 |
| 120 | 1155 | 1067 | 1242 |
| 140 | 689.3 | 640.0 | 738.6 |
| 170 | 344.9 | 322.6 | 367.2 |
| 200 | 187.5 | 176.7 | 198.3 |
| 230 | 109 | 103.4 | 114.6 |
| 250 | 78.3 | 74.55 | 82.05 |

It is recognized that other sensors and conventional components necessary to normal engine operations such as a spark delivery system, an exhaust gas recirculation system, an idle speed control system and the like may be utilized but are not shown in FIG. 1. It is also recognized that the invention may be used to advantage with other types of engines, such as engines having a number of cylinders other than four, or with non-gasoline powered engines.

As shown in FIG. 1, a vehicle dashboard 167 is located in the vehicle and provided with instruments for providing the operator with engine information. Such instruments can include a malfunction indicator light 168 and a coolant temperature gauge 170.

Upon detection of any cylinder head overheating via the cylinder head temperature sensor 165, the computer 102 may provide a signal to drive the coolant temperature gauge 170 to a gauge scale zone indicative of overheating. The system may also be set up so that the coolant temperature gauge 170 is driven to provide a signal indicative of overheating via the computer 102 when the coolant temperature sensor 164 indicates coolant overheating. As a result, the vehicle operator is provided with a warning of overheating.

Figure 3:
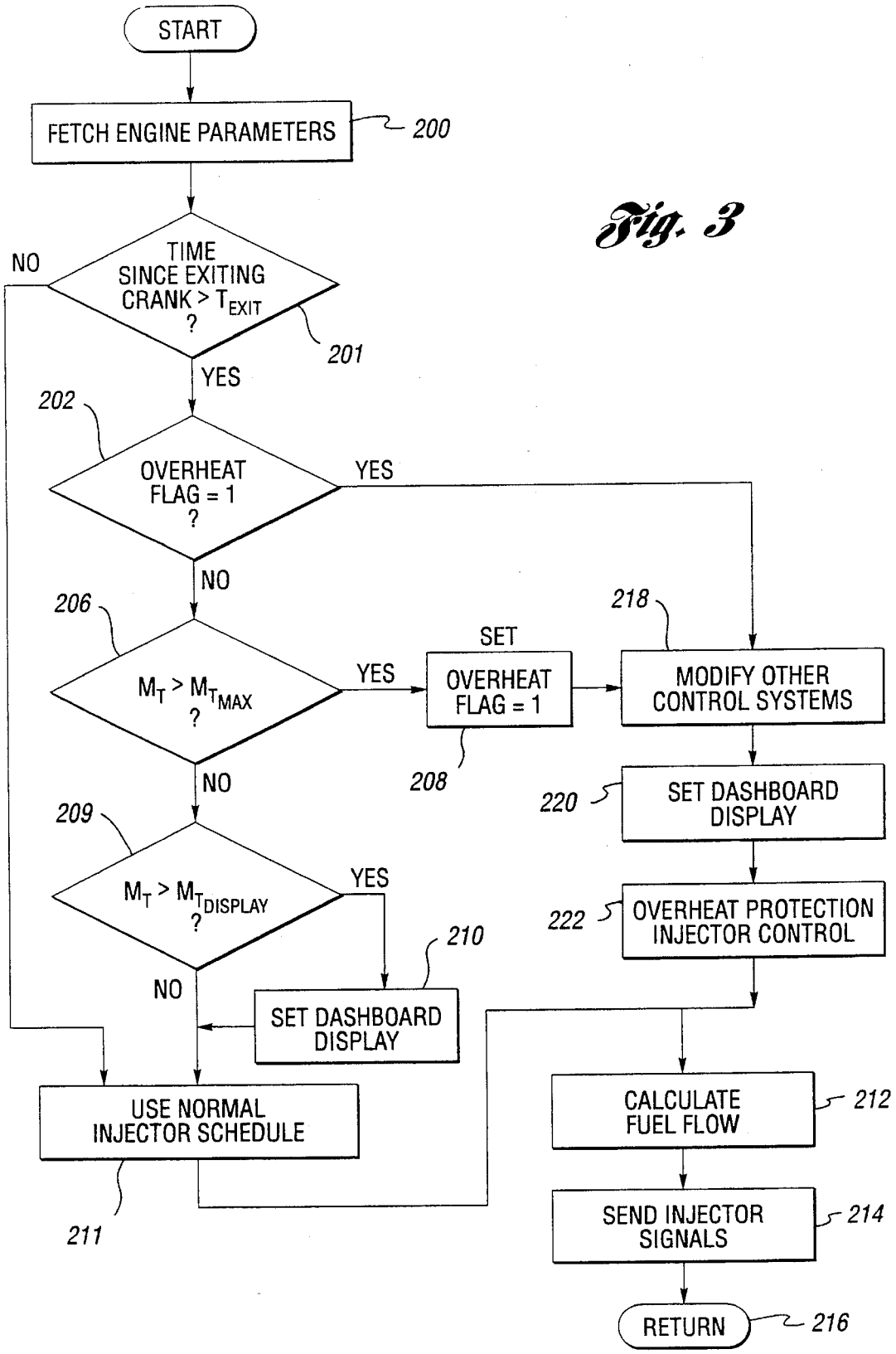
FIG. 3 is a flow chart illustrating various process steps which may be performed to calculate the fuel flow in accordance with an embodiment of this invention.

Referring to FIG. 3, the operation of the microcomputer 102 in controlling the fuel flow is now described. At the start of each sampling interval, the engine parameters are fetched in step 200. Step 201 checks to ensure that the engine is stabilized after start-up before reviewing other parameters. Once the engine is stabilized, step 202 checks to determine if an overheat flag was set to 1 in previous operations. If the flag was not set, step 206 checks to determine if the cylinder head temperature, as determined via the cylinder head temperature sensor 165 has exceeded the maximum temperature limit $MT_{max}$. If the maximum limit $MT_{max}$ is exceeded, step 208 sets the overhead flag to 1. If the maximum limit $MT_{max}$ is not exceeded, step 209 checks to determine if the cylinder head temperature, as determined via the cylinder head temperature sensor 165, has exceeded the temperature displayed $MT_{display}$ indicated by the coolant temperature gauge 170. If the display temperature $MT_{display}$ is exceeded, step 210 provides a driving signal to the coolant temperature gauge 170 in order to drive the coolant temperature gauge 170 to an overheat signal. Following step 210, or if the display temperature $MT_{display}$ is not exceeded in step 209, the microcomputer 102 in a conventional manner determines the injector firing schedule in step 211, calculates fuel flow in step 212, and in step 214 fires the injectors as determined by the schedule previously determined in step 211. Step 216 returns the fuel flow control routine to the main routine. Those skilled in the art will recognize that the above described steps 200 and 211 through 216 correspond to a normal fuel flow control routine.

However, if the cylinder head overhears, and the overheat flag has been set to 1 in step 202 or 208, the fuel flow control proceeds to step 218. Step 218 informs other engine and vehicle control systems that cylinder head overheating has occurred. Those controlled systems are vehicle-dependent and may include but are not limited to a spark delivery system, an exhaust gas recirculation system, an idle speed control system, transmission controls, a cooling fan control, an air-conditioner control, and the like.

Step 220 may provide a driving signal to the coolant temperature gauge 170 located in the vehicle dashboard 167.

Finally, step 222 provides an overheat protection injector control routine in accordance with the invention, and continues to step 212 in a conventional manner. The microcomputer operations in this step 222 are set forth in this disclosure.

Figure 4:
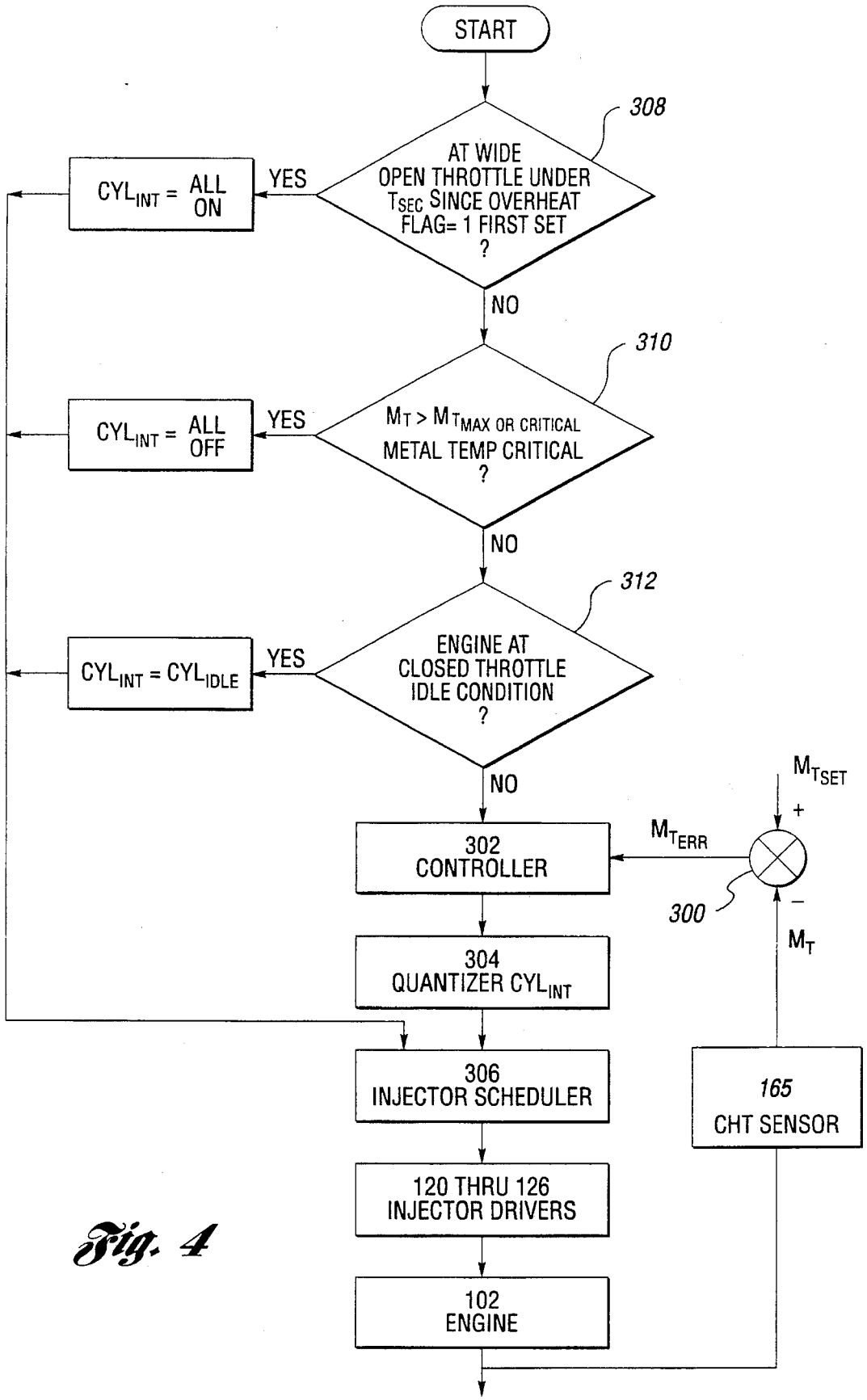
FIG. 4 is a block diagram of an overheat protection injector control routine in accordance with an embodiment of this invention.

The operation of the overheat protection control system in controlling the injector firing schedule upon detection of cylinder head overheating is now described with particular reference to the control block diagram shown in FIG. 4.

The overheat protection control system consists of an error calculation means 300, an overhead protection controller 302, a quantizer means 304, an injector scheduler means 306, the injector drivers 120 through 126, the internal combustion engine 102, and the cylinder head temperature sensor 165. Before entering the overheat protection controller 302, if the computer 100 detects any one of three modes of engine operation, the overheat protection controller 302 will be bypassed in lieu of specific fixed injector patterns. If the throttle position sensor 146 indicates wide open throttle mode when overheat flag is first set=1, all injectors remain on for $T_{sec}$ (308). If the cylinder head temperature sensor 165 indicates a temperature which exceeds a critical temperature, all injectors are turned off (310). If throttle position sensor 146 and engine speed indicate that the engine is idling, a fixed number of injectors are fired (312). Overall, the overheat protection control system represents a feedback closed loop control system having as an input a cylinder head temperature set point $MT_{sel}$, and a controlled output cylinder head metal temperature MT. The error calculation 300 calculates an error signal: $MT_{err}=MT_{set}-MT$. The controller 302 then determines how many cylinders should be deactivated to maintain the engine temperature set point $MT_{set}$. Controller 302 may be of any conventional type, for example, a proportional and integral PI controller. The difference equation suited for digital microcomputer computations in the simplest form is:

$$CYL(i)=CYL(i-1)+P*(MT_{err}(i)-MT_{err}(i-1))+I*DELTAT*MT_{err}(i-1)$$

where: i and (i−1) indicate current and previous results of calculations or measurements;

P and I are controller proportional and integral gains;

DELTAT is a microcomputer sampling time interval; and

CYL is calculated number of turned off cylinders which may be any non-integer number.

Figure 5:
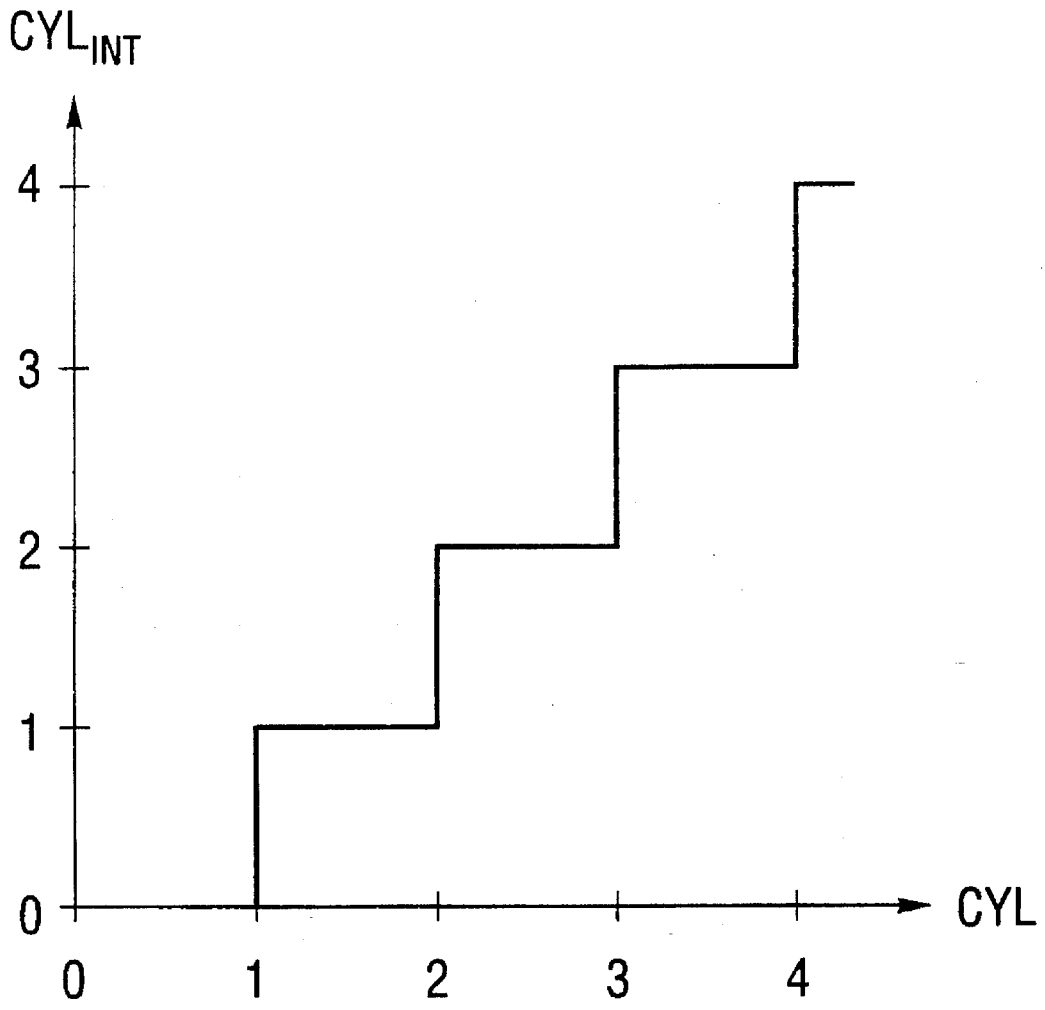
FIG. 5 is a graph showing quantizer output as a function of the controller output.

Quantizer 304 has two functions. First, it converts the non-integer number of cylinders CYL to integer number $CYL_{int}$ in accordance with FIG. 5. Second, it limits the maximum $CYL_{max}$ and the minimum $CYL_{min}$ number of cylinders to be turned off. The latter feature may be especially important for engines with a number of cylinders more than four. For example, in an eight cylinder engine the maximum number of cylinders $CYL_{max}$=7, while the minimum number of cylinders $CYL_{min}$= 1.

The injector scheduler 306 receives as an input the integer number of cylinders to be turned off $CYL_{int}$ and outputs a bit pattern which is indicative of a proper sequence of turned off cylinders and cylinder rotation to achieve an uniform firing order and cylinder temperature by ensuring that no one cylinder is fired constantly.

To achieve the cylinder rotation, a firing cycle consisting of $CYL_{num}$ combustion events may be used, where $CYL_{num}$ is a cylinder number for a particular engine, is created. During this cycle, from $CYL_{min}$ to $CYL_{max}$ cylinders may be turned off according to output of quantizer 304.

FIG. 6 shows an example bit pattern of turned off cylinders and associated calibration for a four-cylinder engine. This bit pattern minimizes effects of torque fluctuations on vehicle driveability. Those skilled in the art may design bit patterns for engines with a cylinder number other than four.

FIG. 7 shows an example of fired and turned off cylinders over several engine cycle periods when two cylinders should be turned off out of four combustion events for a four-cylinder engine. Note that the third engine cycle period has the same pattern as the first engine cycle, and over these cycles, two cylinders are turned off on a rotational basis. Also note, that $CYL_{max}$ should not be larger than $CYL_{num}$, i.e., not more than four cylinders can be turned off for a four-cylinder engine.

While a firing cycle consisting of $CYL_{num}$ combustion events may be used to achieve cylinder rotation, it has been found more desirable to rotate the activated cylinders at a point in time of approximately 100 engine cycles. Because the first firing cycle after rotation results in one-half the normal torque output, rotation at approximately 100 engine cycles minimizes the rough operation of the engine which might otherwise result. While a cylinder rotation at every engine cycle would be desirable to minimize temperature gradients between the fired and inhibited cylinders, it has been found that rotation every 100 engine cycles or so maintains such a temperature gradient in a non-damaging range. Otherwise, the temperature gradient could result in structural damage to the cylinder head due to the inherent stresses created by such a condition.

Accordingly, as determined by the computer 102, each cylinder rotation would generally occur every 100 engine cycles, at which point a new bit pattern would be outputted. In accordance with this new bit pattern, different cylinders would be turned off to ensure that no one cylinder is fired constantly.

In general, and especially in the case of an engine having a V-configuration, it has been found that smoother operation results when an even number of cylinders are deactivated any one time, the deactivated cylinders being evenly split on each side of the V to achieve firing balance. For example, FIG. 8 illustrates the possible firing cycle of an eight cylinder engine during five rotations, each occurring every 100 engine cycles when it is desired to deactivate two cylinders in order to achieve proper cooling. Note that the fifth rotation has the same pattern as the first rotation. FIG. 9 illustrates the possible firing cycle of an eight cylinder V8 engine during three cylinder rotations when it is desired to deactivate four cylinders in order to achieve proper cooling. Note that the third rotation has the same pattern as the first rotation.

Figure 10A:
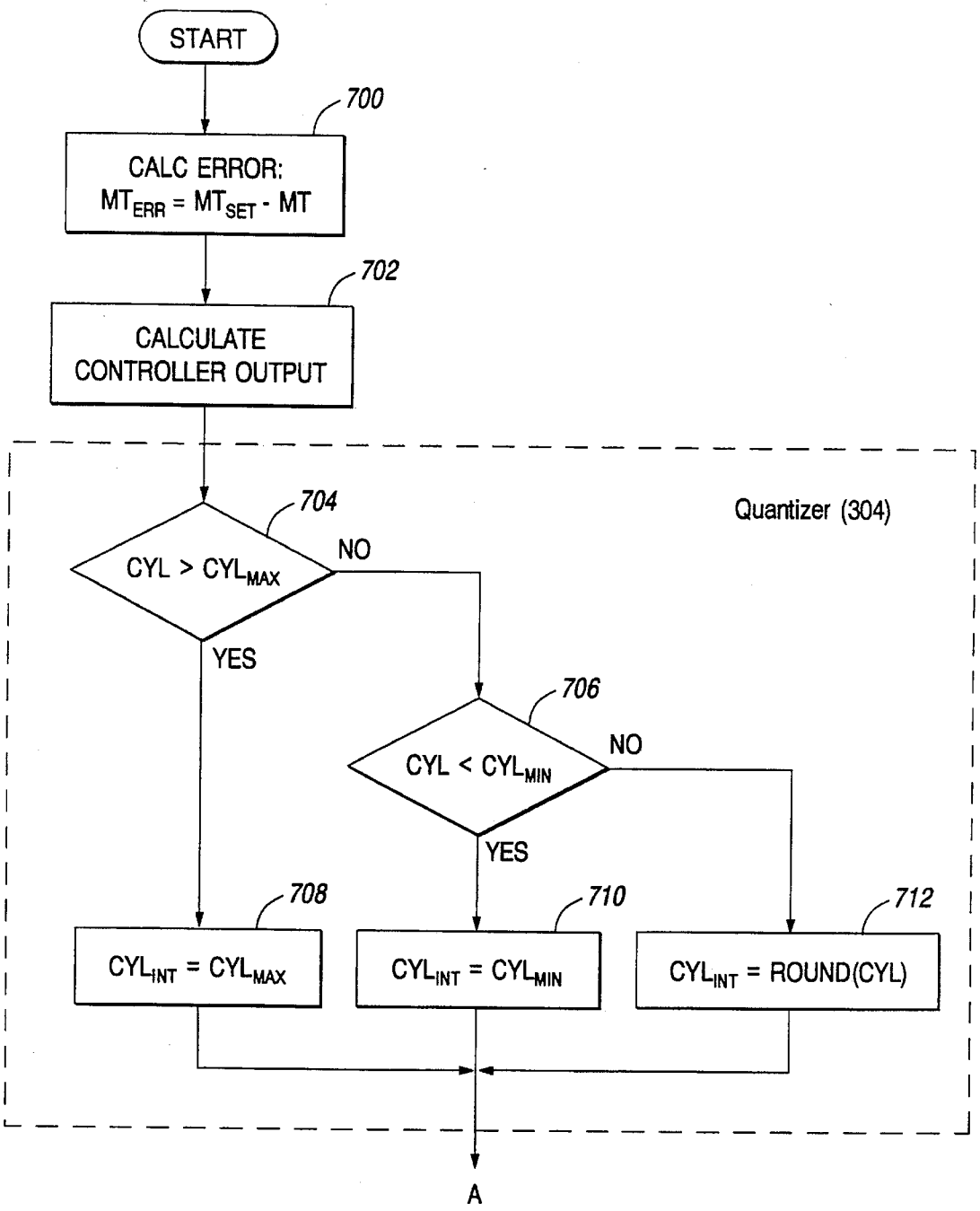
FIGS. 10*a* and 10*b* are flow charts illustrating the injector scheduler process steps which can be performed in an embodiment of this invention.
Figure 10B:
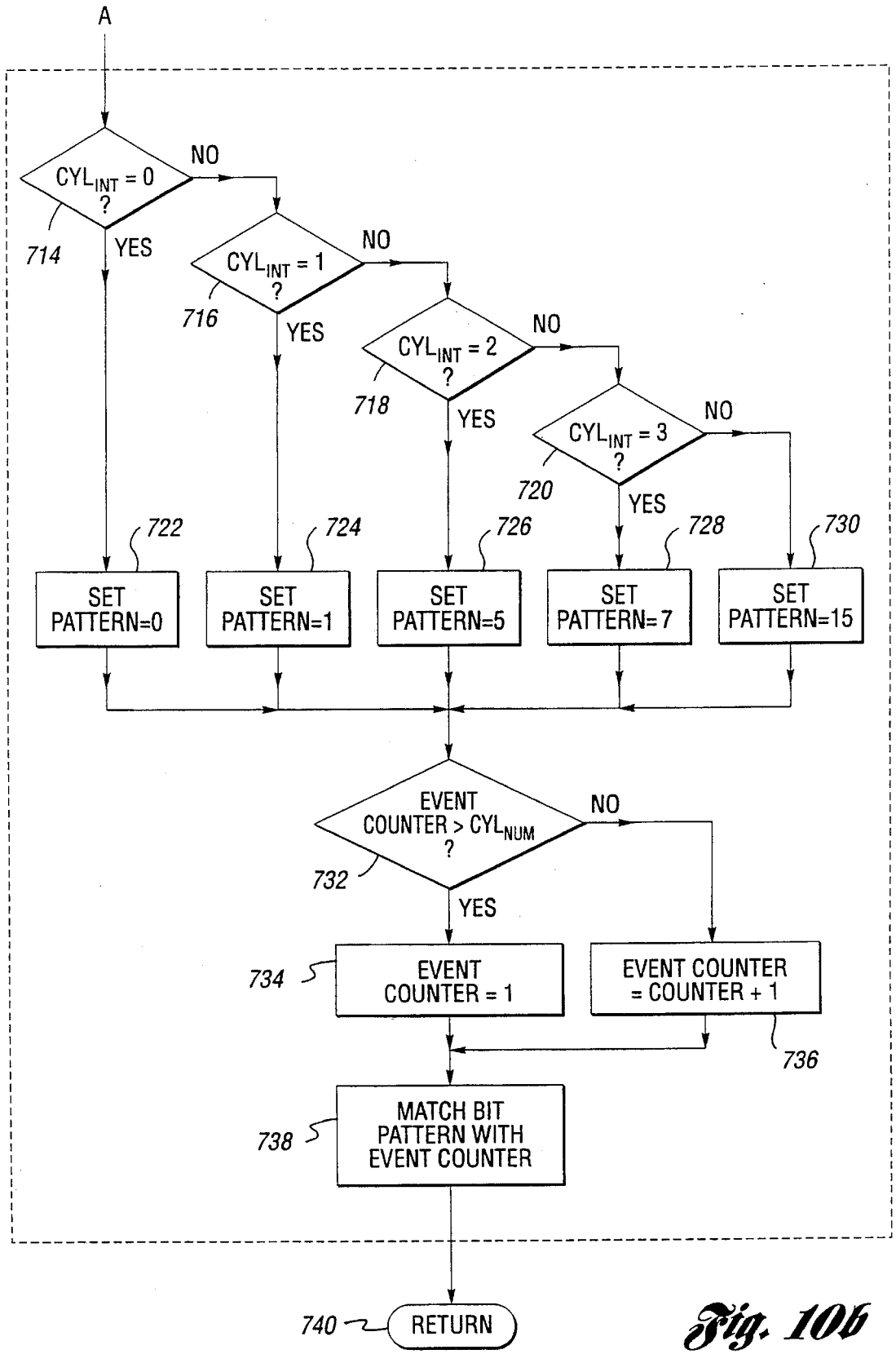

The operation of microcomputer 100 in controlling the overheat protection system in step 222 of FIG. 3 is now described with particular reference to the flow chart shown in FIGS. 10*a* and 10*b*. This description follows and is referenced to the control block diagram in FIG. 4.

After the overheat protection control 222 is called, step 700 calculates on error signal $MT_{err}$ corresponding to the error calculation means 300. Step 702 then calculates controller output signal CYL corresponding to controller 302. Step 704 through 712 correspond to the quantizer means 304. Step 704 limits the maximum number $CYL_{max}$ of turned off cylinders and step 706 limits the minimum number $CYL_{min}$ of turned off cylinders, to a preset limit. Steps 708, 710 and 712 round the calculated cylinder number CYL to the nearest integer $CYL_{int}$. Remaining steps 714 through 738 correspond to the injector scheduler means 306. Steps 714, 716, 718 and 720 match the integer cylinder number $CYL_{int}$ with a bit pattern according to FIG. 5, in corresponding steps 722, 724, 726, 728 and 730. Step 736 increments an event counter each time this subroutine is called. However, if in step 732 event counter is larger than $CYL_{num}$, step 734 resets the counter to 1. Finally, step 738 matches the counter number to a bit in the bit pattern, and if the corresponding bit is reset to 0, the injector is fired. Otherwise, if the bit is set to 1, the injector is not fired, thus turning the corresponding cylinder off. Step 740 returns this subroutine, and operation of the microcomputer 100 in firing the injectors continues in a conventional manner.

It is to be understood that the present invention has been described in an illustrative manner and the terminology which has been used is intended to be in the nature of words of description rather than of limitation. Obviously, many modifications and variations of the present invention are possible in light of the above teachings. Therefore, it is also to be understood that, within the scope of the following claims, the invention may be practiced otherwise than as specifically described.

What is claimed is:

1. An overheat protection system for an internal combustion engine having cylinders and a cylinder head, the cylinders being independently deactivatable, the overheat protection system comprising:

a cylinder head temperature sensor operably coupled to sense the temperature of the cylinder head; and a control system operably coupled to the cylinders and the cylinder head temperature sensor such that when the temperature of the cylinder head exceeds a maximum level, the control system deactivates at least one of the cylinders and rotates the deactivation of at least one of the engine cylinders such that no one cylinder is constantly fired thus providing engine cooling by drawing fresh air through the at least one deactivated cylinders.

2. The overheat protection system of claim 1 wherein the number of cylinders deactivated is an even number.

3. The overheat protection system of claim 1 wherein the deactivation of at least one of the cylinders is rotated approximately every one hundred engine cycles.

4. The overheat protection system of claim 1 wherein the cylinder head temperature sensor is a thermistor assembly.

5. The overheat protection system of claim 4 wherein the thermistor assembly is mounted within the cylinder head.

6. The overheat protection system of claim 1 wherein the control system comprises a microcomputer.

7. An overheat protection system for an internal combustion engine having an equal number of cylinders, cylinder heads, fuel injectors which provide fuel to the cylinders, and fuel injector drivers, each fuel injector being operably connected to a fuel injector driver, the overheat protection system comprising:

a cylinder head temperature sensor operably coupled to sense the temperature of the cylinder head; and a control system coupled to the fuel injector drivers and to the cylinder head temperature sensor such that when the control system receives signals from the cylinder head temperature sensor that the temperature of the cylinder head has exceeded a maximum level the control system will de-energize at least one of the fuel injectors via the corresponding fuel injector driver and rotate the at least one of the de-energized fuel injectors in such a way that no one fuel injector is constantly energized thus providing engine cooling by drawing fresh air through the at least one cylinders not being provided with fuel.

8. The overheat protection system of claim 7 wherein the number of fuel injectors de-energized is an even number.

9. The overheat protection system of claim 7 wherein the de-energization of at least one of the fuel injectors is rotated approximately every one hundred engine cycles.

10. The overheat protection system of claim 7 wherein the cylinder head temperature sensor is a thermistor assembly.

11. The overheat protection system of claim 10 wherein the thermistor assembly is mounted within the cylinder head.

12. The overheat protection system of claim 7 wherein the control system comprises a microcomputer.

13. A method for protecting an internal combustion engine from overheating, the internal combustion engine having cylinders and cylinder heads, the cylinders being independently deactivatable, the method comprising:

sensing the temperature of the cylinder head;

deactivating at least one of the engine cylinders when the temperature of the cylinder head exceeds a maximum level; and rotating the deactivation of at least one of the engine cylinders such that no one cylinder is constantly fired thus providing engine cooling by drawing fresh air through the at least one deactivated cylinders.

14. The method of claim 13 wherein an even number of cylinders are deactivated when the temperature of the cylinder head exceeds a maximum level.

15. The method of claim 13 wherein the deactivation of at least one of the engine cylinders is rotated approximately every one hundred engine cycles.

16. The method of claim 13 wherein the step of sensing the temperature of the cylinder head is accomplished by using a thermistor assembly.

17. The method of claim 16 wherein the thermistor assembly is mounted within the cylinder head.

18. An overheat protection system for an internal combustion engine having cylinders, cylinder heads, and drivers, each cylinder being operably coupled to a corresponding independent driver, the overheat protection system comprising:

a cylinder head temperature sensor operably coupled to sense the temperature of the cylinder head; and a control system operably coupled to the drivers and the cylinder head temperature sensor such that when the temperature of the cylinder head exceeds a maximum level, the control system deactivates at least one of the cylinders via the drivers and rotates the deactivation of at least one of the engine cylinders such that no one cylinder is constantly fired thus providing engine cooling by drawing fresh air through the at least one deactivated cylinders.

19. The overheat protection system of claim 18 wherein the number of cylinders deactivated is an even number.

20. The overheat protection system of claim 18 wherein the deactivation of at least one of the cylinders is rotated approximately every one hundred engine cycles.

21. The overheat protection system of claim 18 wherein the cylinder head temperature sensor is a thermistor assembly.

22. The overheat protection system of claim 18 wherein the thermistor assembly is mounted within the cylinder head.

23. The overheat protection system of claim 18 wherein the control system comprises a microcomputer.

* * * * *